US006124539A

United States Patent [19]

Barnes, III

[11] Patent Number: 6,124,539

[45] Date of Patent: Sep. 26, 2000

[54] MAGNETICALLY DRIVEN WIND CHIME APPARATUS

[76] Inventor: Kyle Durland Barnes, III, 245 Coast Blvd. #3C, La Jolla, Calif. 92037

[21] Appl. No.: 09/288,271

[22] Filed: Apr. 8, 1999

[51] Int. Cl.[7] ..... G10D 13/08

[52] U.S. Cl. ..... 84/402

[58] Field of Search ..... 84/402–410

[56] References Cited

U.S. PATENT DOCUMENTS 5,744,736 4/1998 Chang ..... 84/402

*Primary Examiner*—Stanley J. Witkowski
*Attorney, Agent, or Firm*—Walter W. Duft

[57] ABSTRACT

A magnetically driven wind chime apparatus includes a first outdoor pendulum assembly mounted on the outside of a window or other barrier and a second indoor pendulum assembly mounted on the inside of the window or other barrier. The outdoor pendulum assembly includes a first support body, a first pendulum rod having one end pivotally connected to the first support body, and a first magnetic pendulum mounted to a second end of the first pendulum rod. The indoor pendulum assembly includes a second support body, a second pendulum rod having one end pivotally connected to the second support body, and a second magnetic pendulum mounted to a second end of the second pendulum rod. A sail is mounted on the first pendulum rod. A wind chime assembly is connected to the second pendulum rod. The outdoor and indoor pendulum assemblies are mounted such that the first and second magnetic pendulums are in opposing relationship with their magnetic fields aligned so that each exerts a mutual magnetic repulsive (or attractive) force on the other. In this way, the outdoor pendulum assembly imparts motion to the indoor pendulum assembly as the sail is moved by a wind. The indoor pendulum assembly in turn imparts motion to the wind chime assembly as the indoor pendulum assembly is moved by the outdoor pendulum assembly.

20 Claims, 15 Drawing Sheets

MAGNETICALLY DRIVEN WIND CHIME APPARATUS

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to wind actuated chimes, and more particularly, to improvements therein which allow outdoor wind motion to be used for actuating an indoor wind chime so as to simulate a wind chime positioned outdoors and responding to the wind motion. More broadly, the invention concerns a magnetically coupled, trans-barrier, motion transmitting device for transferring a force applied on one side of a barrier to a device located on the other side of the barrier without penetrating or circumventing the barrier.

2. Description of the Prior Art

Wind chimes are a popular novelty found on many porches and patios. The random, atonal sounds produced as breezes stir the chimes create a natural ambiance that is pleasing to many.

Of course, the natural wind forces that produce sounds from a wind chime are not available in an indoor environment unless windows or doors are left open, and weather conditions often preclude such practices. Without wind power, persons desiring to achieve the effect of an outdoor wind chime within an enclosure can only do so using mechanization. In some quarters, however, the notion of a mechanized wind chime is unacceptable. What would be preferable is a wind chime apparatus that operates indoors, yet relies on natural wind forces to produce the sounds of an outdoor wind chime. What is required is way to harness the power of the wind and convey its forces indoors where it can be used to produce the desired effect. Preferably, this objective should be achieved without the use of physical links (mechanical, electrical, pneumatic or gas pressure, hydraulic or fluid pressure, etc.) that require penetration or circumvention of the barrier (such as a window) that separates the indoor environment from the outdoor environment.

What would be further desirable, considering the foregoing problem from a broader perspective, is a trans-barrier motion transmitting system that can be used for coupling a force applied to a sensing or impelled device located on one side of a barrier to a receiving device located on the other side of the barrier, without penetrating or circumventing the barrier. The system should be easy to install and should not require any modification of existing structure. The driving force could be the wind as well as other forces, natural or otherwise, and the receiving device could be a wind chime or any other device that is capable of being driven by the outside force.

BRIEF SUMMARY OF THE INVENTION

A solution to the first above-stated objective is provided by a magnetically driven wind chime apparatus in accordance with the invention, and a solution to the second above-stated objective is provided by a magnetically coupled, trans-barrier, motion transmitting apparatus in accordance with the invention. In its preferred embodiments, the wind chime apparatus of the present invention includes a first outdoor assembly mounted on the outdoor side of a window or other barrier and a second indoor assembly mounted on the indoor side of the window or other barrier. The outdoor assembly includes a first movable magnet and a sail, and the indoor assembly includes a second movable magnet and a wind chime. The first and second magnets are disposed in opposing relationship and with their magnetic fields aligned so that each exerts a mutual magnetic repulsive (or attractive) force on the other. With the magnets so positioned, the outdoor assembly imparts motion to the indoor assembly as the sail is moved by the wind, and the wind chime produces its characteristic chiming sounds as the indoor assembly is moved by the outdoor assembly.

In its most preferred embodiment, the magnetically driven wind chime apparatus of the present invention includes a first outdoor pendulum assembly mounted on the outside of a window or other barrier and a second indoor pendulum assembly mounted on the inside of the window or other barrier. The outdoor pendulum assembly includes a first support body, a first pendulum rod having one end pivotally connected to the first support body, and a first magnetic pendulum mounted to a second end of the first pendulum rod. The indoor pendulum assembly includes a second support body, a second pendulum rod having one end pivotally connected to the second support body, and a second magnetic pendulum mounted to a second end of the second pendulum rod. A sail is mounted on the first pendulum rod. A wind chime assembly is connected to the second pendulum rod. The indoor and outdoor pendulum assemblies are mounted such that the first and second magnetic pendulums are in opposing relationship with their magnetic fields aligned so that each exerts a mutual magnetic repulsive (or attractive) force on the other. In this way, the outdoor pendulum assembly imparts motion to the indoor pendulum assembly as the sail is moved by a wind. The indoor pendulum assembly in turn imparts motion to the wind chime assembly as the indoor pendulum assembly is moved by the outdoor pendulum assembly.

In its preferred embodiments, the magnetically coupled, trans-barrier, motion transmitting apparatus of the present invention includes a first assembly mounted on a first side of the window or other barrier, and the first assembly has a first magnet adapted for translational movement. A second assembly is mounted on a second side of the window or other barrier, and has a second magnet that is also adapted for translational movement. The first and second magnets are disposed in opposing relationship with their magnetic fields aligned so that each exerts a mutual magnetic repulsive (or attractive) force on the other. Thus arranged, the first magnet imparts translational motion to the second magnet as said first magnet engages in translational motion.

In one aspect of the aforementioned magnetically coupled, trans-barrier, motion transmitting apparatus, the first assembly includes a first support body mounted on the window or other barrier and a first pendulum rod pivotally connected at a first end thereof to the first support body. The first magnet is a magnetic pendulum mounted to a second end of the first pendulum body. Similarly , the second assembly includes a second support body mounted on the window or other barrier and a second pendulum rod pivotally connected at a first end thereof to the second support body. The second magnet is a magnetic pendulum mounted to a second end of the second pendulum body.

In another aspect of the magnetically coupled, trans-barrier, motion transmitting apparatus, the first assembly includes a first support body mounted on the window or other barrier and a first pivot rod pivotally connected at a central portion thereof to the first support body. The first magnet includes a pair of magnets, one of which is mounted to each end of the first pivot rod. Similarly, the second assembly includes a second support body mounted on the window or other barrier and a second pivot rod pivotally connected at a central portion thereof to the second support body. The second magnet includes a pair of magnets one of which is mounted to each end of the second pivot rod.

BRIEF DESCRIPTION OF THE SEVERAL VIEWS OF THE DRAWING

The foregoing and other features and advantages of the present invention will be apparent from the following more particular description of the preferred embodiments of the invention, as illustrated in the accompanying Drawing, in which.

DETAILED DESCRIPTION OF THE INVENTION

Figure 1:
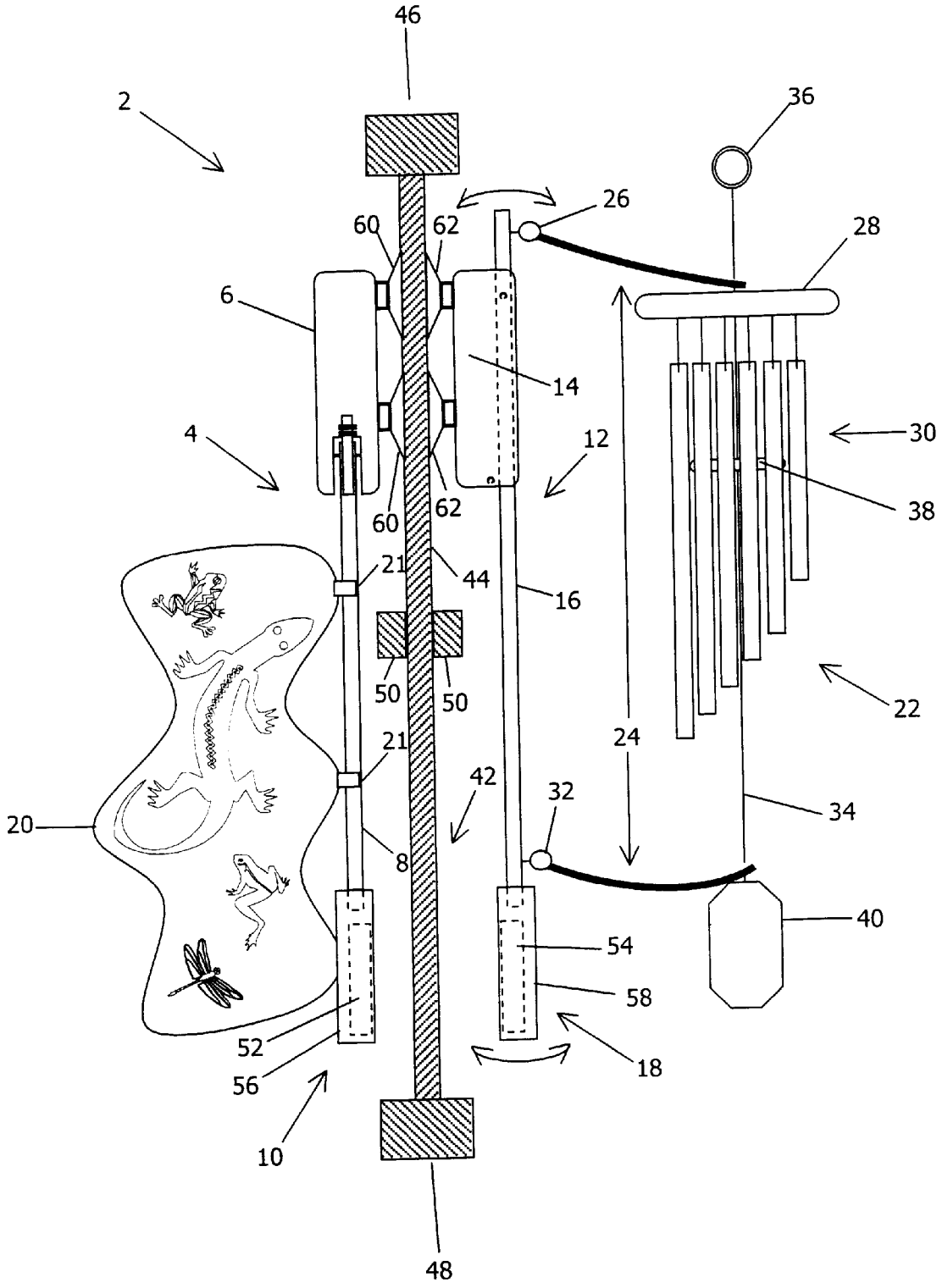
FIG. 1 is a side elevation view of a magnetically driven wind chime apparatus constructed in accordance with the invention, with the apparatus mounted on a window structure, which is shown cross-sectionally.

Turning now to the Drawing, wherein like reference numbers designate like elements in all of the several views.

FIG. 1 illustrates a magnetically driven wind chime apparatus 2 constructed in accordance with one preferred embodiment of the invention. A first outdoor pendulum assembly 4 includes a first support body 6, a first pendulum rod 8 having one end pivotally connected to the first support body 6, and a first magnetic pendulum 10 mounted to a second end of the first pendulum rod 8. A second indoor pendulum assembly 12 includes a second support body 14, a second pendulum rod 16 having one end pivotally connected to the second support body 14, and a second magnetic pendulum 18 mounted to a second end of the second pendulum rod 16. A sail 20 is mounted on the first pendulum rod 8 of the outdoor pendulum assembly 4 using suitable connectors 21, such as plastic clips. Alternatively, the connectors 21 could be elements that extend between and connect to symmetrical sail sheets that are folded around the pendulum rod 8 and affixed together to form a single two-ply sail 20, with the connectors 21 being wrapped around the pendulum rod 8. A wind chime assembly 22 is connected to the second pendulum rod 16 of the indoor pendulum assembly 12 using a pair of upper and lower leashes 24. The upper leash 24 preferably extends between a hook 26 mounted near the upper end of the second pendulum rod 16 and a wind chime support body 28, from which are suspended a plurality of wind chimes 30. The lower leash 24 extends between a hook 32 mounted near the lower end of the second pendulum rod 16 and a suspension string 34 that is connected to an upper suspension ring 36, and which supports a wind chime striker 38 and a paddle 40. The lower leash could also mount to the paddle 40. Similarly, the upper leash 24 could mount to the suspension string 34 instead of the support body 28 insofar as the support body 28 would be typically mounted to the suspension string 34 or the suspension ring 36 to which the suspension string is attached. If desired, the hooks 26 and 32 could also be eliminated and the upper and lower leashes 24 could be tied or otherwise attached directly to the second pendulum rod 16.

The indoor and outdoor pendulum assemblies 4 and 12 are respectively mounted to the outside and inside surfaces of a window 42 that includes the usual window pane 44, a pair of upper and lower window frames 46 and 48, and a horizontal mullion 50. The first and second magnetic pendulums 10 and 18 are placed in opposing relationship with their magnetic fields aligned so that each exerts a mutual magnetic repulsive (or attractive) force on the other. With the first and second magnetic pendulums 10 and 18 magnetically coupled in this fashion, the outdoor pendulum assembly 4 is able to impart motion to the indoor pendulum assembly 12 as the sail 20 is moved by the wind. The indoor pendulum assembly 12, in turn, imparts motion to the wind chime assembly 22 as the indoor pendulum assembly 12 is moved via the magnetic coupling by the outdoor pendulum assembly 4. It will be appreciated that the pendulum assemblies 4 and 12 could be mounted to structural barriers other than windows, including doors, walls, and ceilings, provided the magnetic pendulums 10 and 18 have sufficient magnetic strength and the barrier does not contain materials that negate the magnetic couple between the pendulums.

Figure 2:
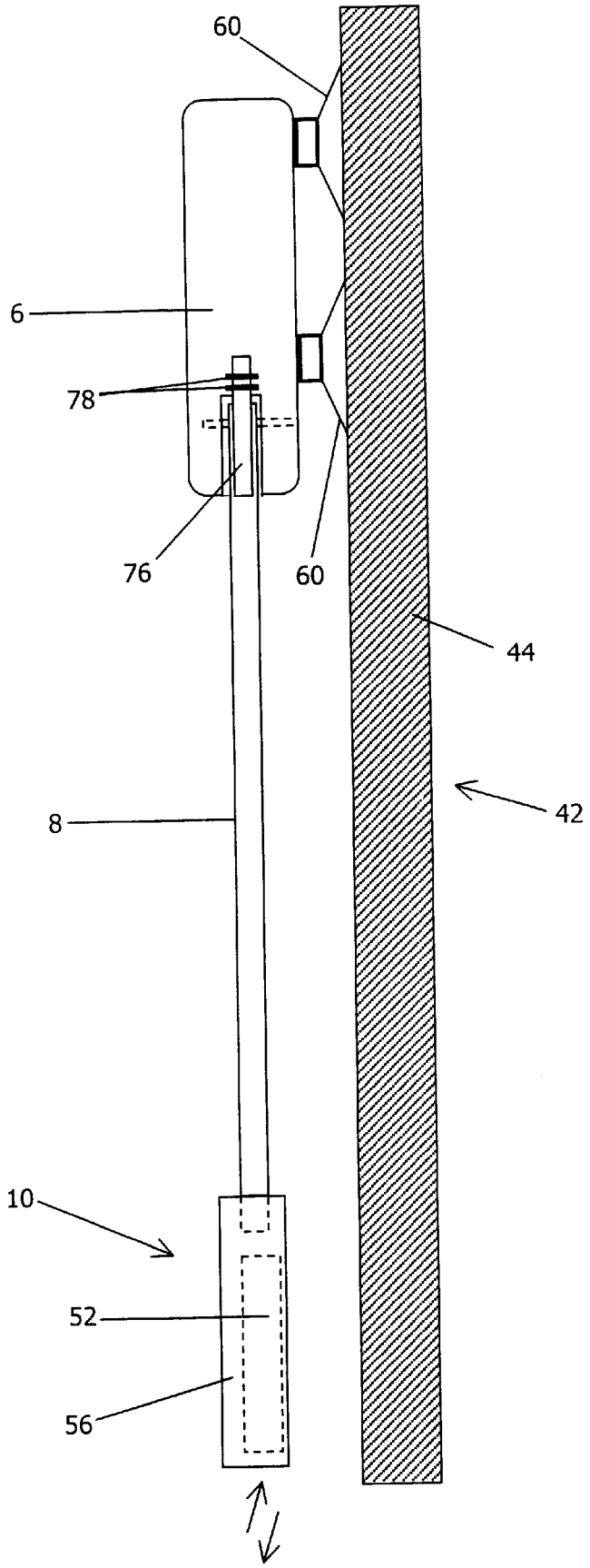
FIG. 2 is a side elevation view showing details of an outdoor pendulum assembly of the magnetically driven wind chime apparatus of FIG. 1.
Figure 2A:
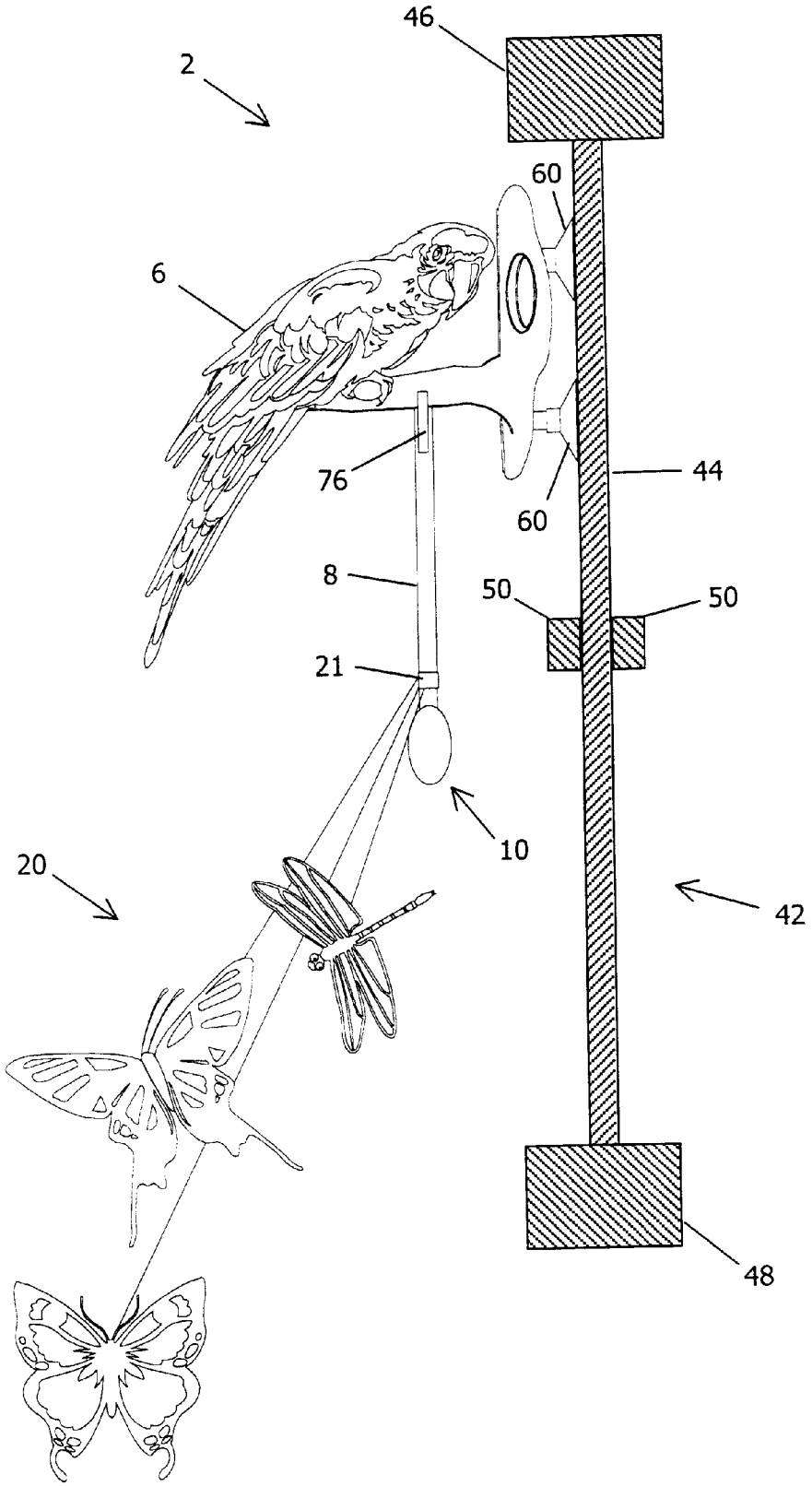
FIG. 2*a* is a side elevation view showing an alternative outdoor pendulum assembly.
Figure 2B:
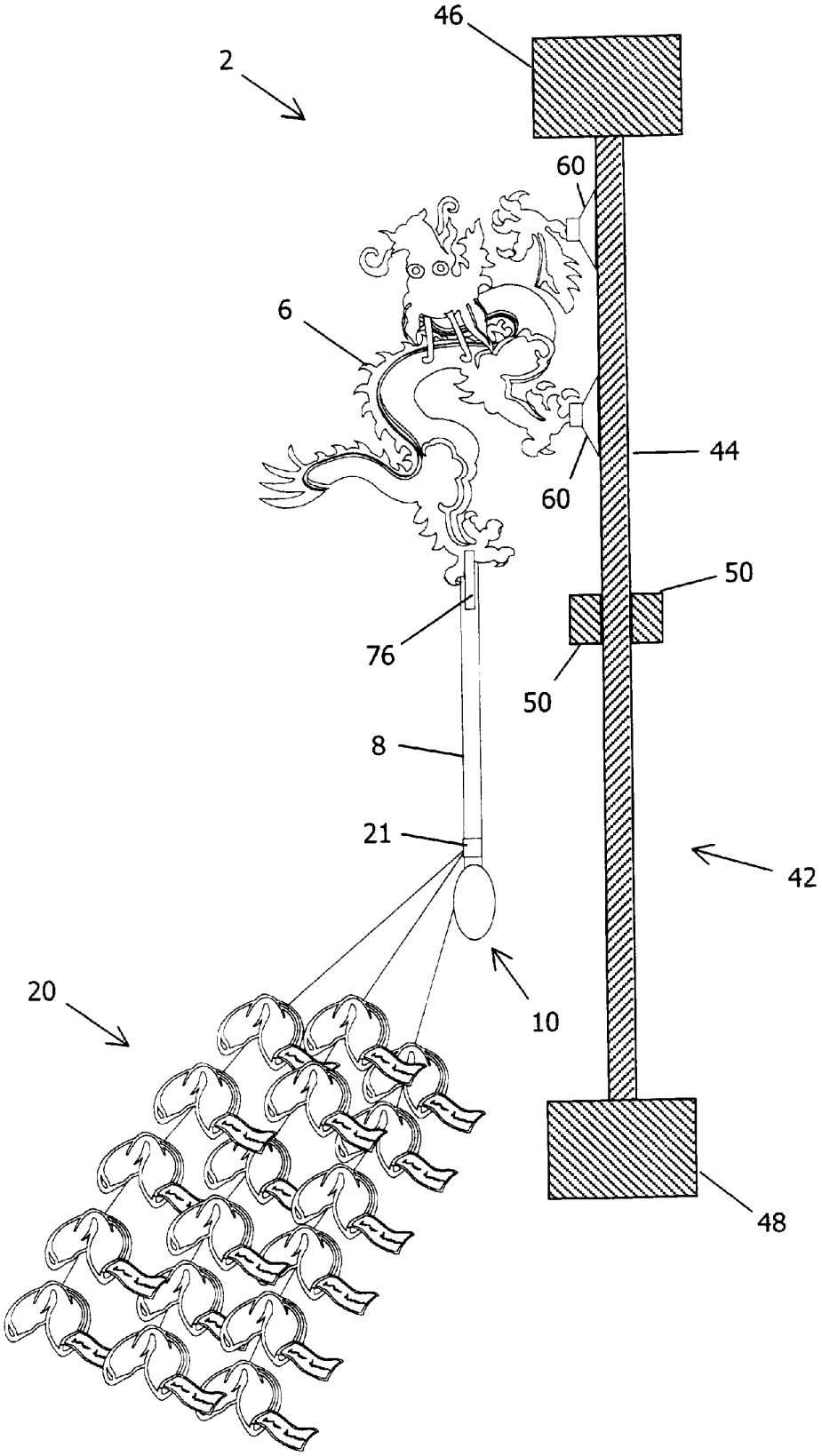
FIG. 2*b* is a side elevation view showing another alternative outdoor pendulum assembly.
Figure 5:
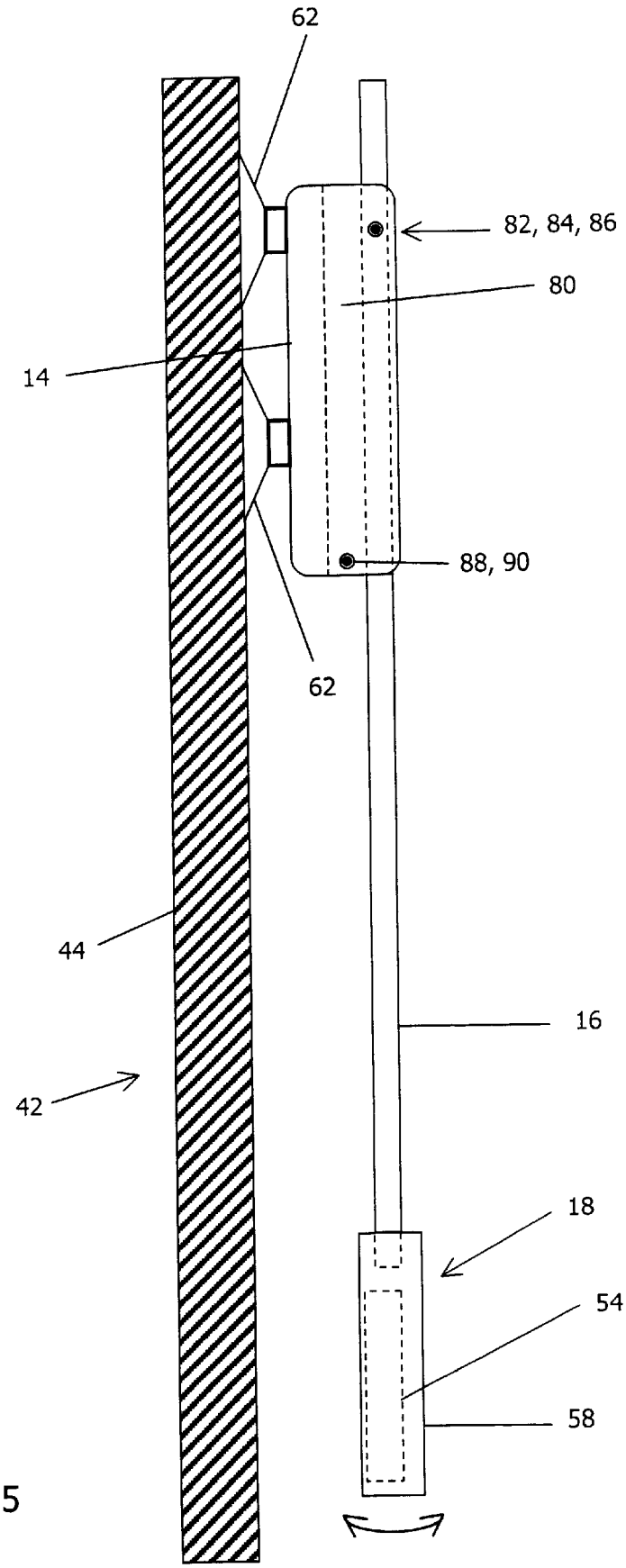
FIG. 5 is a side elevation view showing details of an indoor pendulum assembly of the magnetically driven wind chime apparatus of FIG. 1.

Referring now to FIGS. 2 and 5, the indoor and outdoor pendulum assemblies 4 and 12 can be made from any of a variety of suitable materials. By way of example only, the body members 6 and 14 could be made from metal but are preferably formed out of wood or molded plastic for low weight. They could be of any suitable shape, including decorative or stylized figures, as shown by way of example in FIGS. 2*a*, 2*b*, 2*c* and 5*a*. The pendulum rods 8 and 16 could also be made of metal. wood or plastic.

The magnetic pendulums 10 and 18 are preferably made from permanent magnets 52 and 54 in the shape of disks, bars, horseshoes, etc. that are respectively seated in non-magnetic pendulum housings 56 and 58, made from wood or plastic. The magnets 52 and 54 are preferably arranged so that their magnetic poles are aligned perpendicular to the window 42 (or other barrier), so that one pole is proximate the window 42 (or other barrier) while the other pole is situated distally from the window 42 (or other barrier). In this way, one pole (either north or south) of the magnet 52 will magnetically engage one pole (either north or south) of the magnet 54. Alternatively, as described in more detail below, the magnetic poles of the magnets 52 and 54, could be aligned parallel to the window 42 (or other barrier), particularly if they are bar or horseshoe magnets. Multiple magnets on each side of the window 42 or other barrier could also be used. The sail 20 can be made from a sheet of plastic or any other suitable material. Alternatively, as suggested by FIGS. 2*a* and 2*b*, the sail 20 could be made from strips of ribbon, vanes. blades, cups or any other impeller configuration made from any suitable material. In short, the term "sail" as used herein shall be understood to refer to any device or assembly that is capable of sensing the wind.

Figure 3:
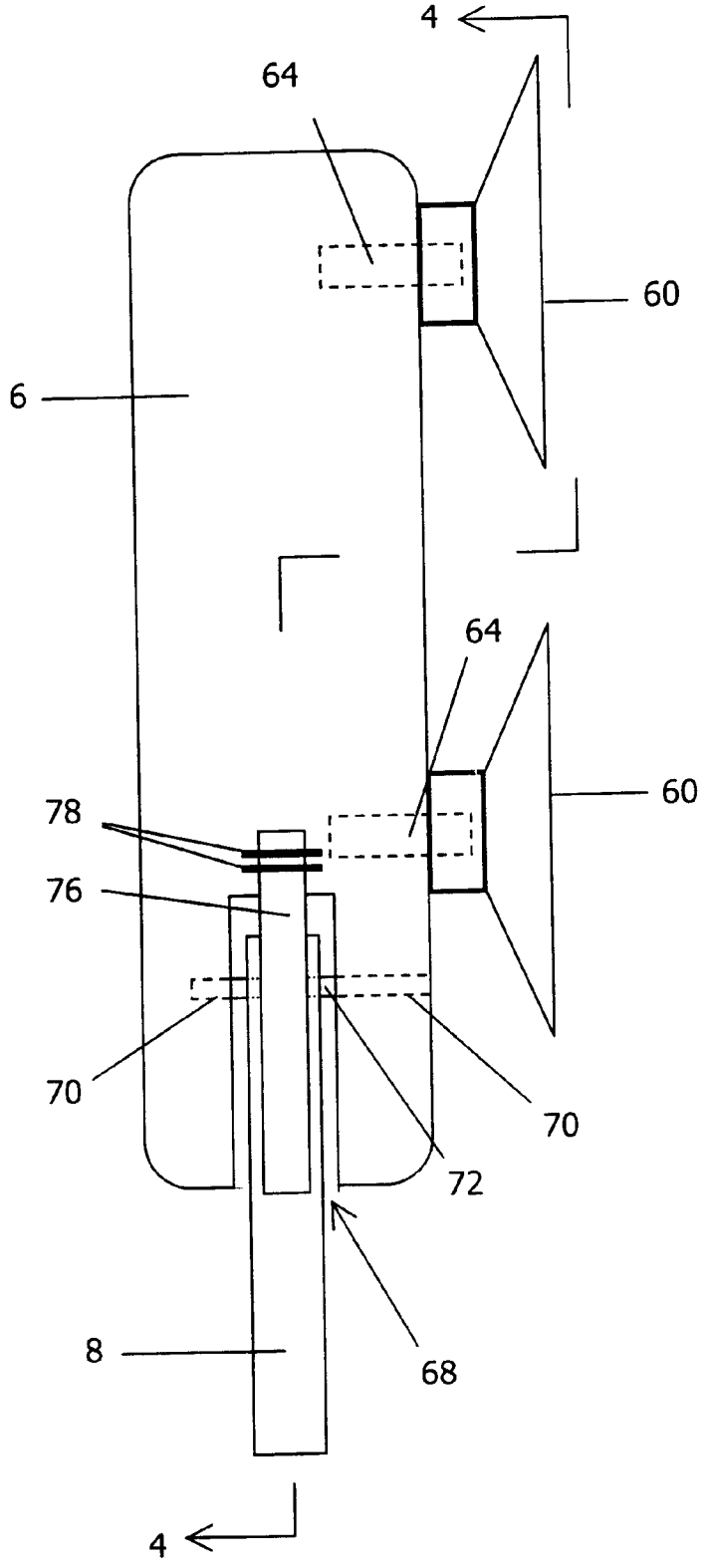
FIG. 3 is a detailed view of the upper portion of the outdoor pendulum assembly of FIG. 2.
Figure 6:
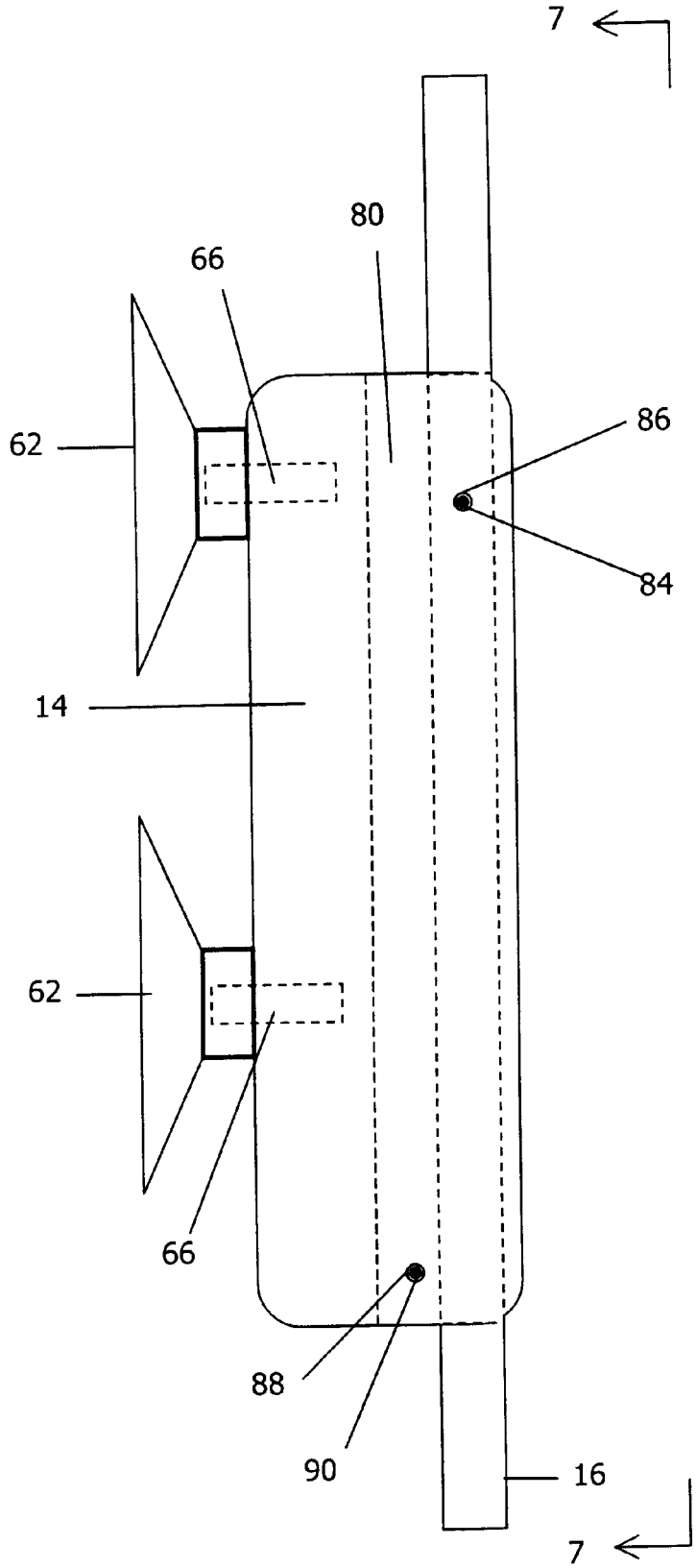
FIG. 6 is a detailed view of the upper portion of the indoor pendulum assembly of FIG. 5.

As best shown in FIGS. 3 and 6, the outdoor and indoor pendulum assemblies 4 and 12 are mounted to the window 42 (or other barrier) by mounting members which are preferably suction cups 60 and 62 attached to the first and second support bodies 6 and 14, respectively. Other kinds of mounting implements, such adhesive, could also be used, but the suction cups 60 and 62 are preferred due to their removability. The suction cups 60 and 62 can be mounted to the support bodies 6 and 14 using pins 64 and 66, respectively. The pins 64 and 66 could be metal, plastic or wooden dowels. Alternatively, if the support bodies 6 and 14 are made from molded plastic, the pins 64 and 66 could be integrally molded as part of the bodies 6 and 14. The suction cups 60 and 62 are made from rubber or the like.

Figure 2C:
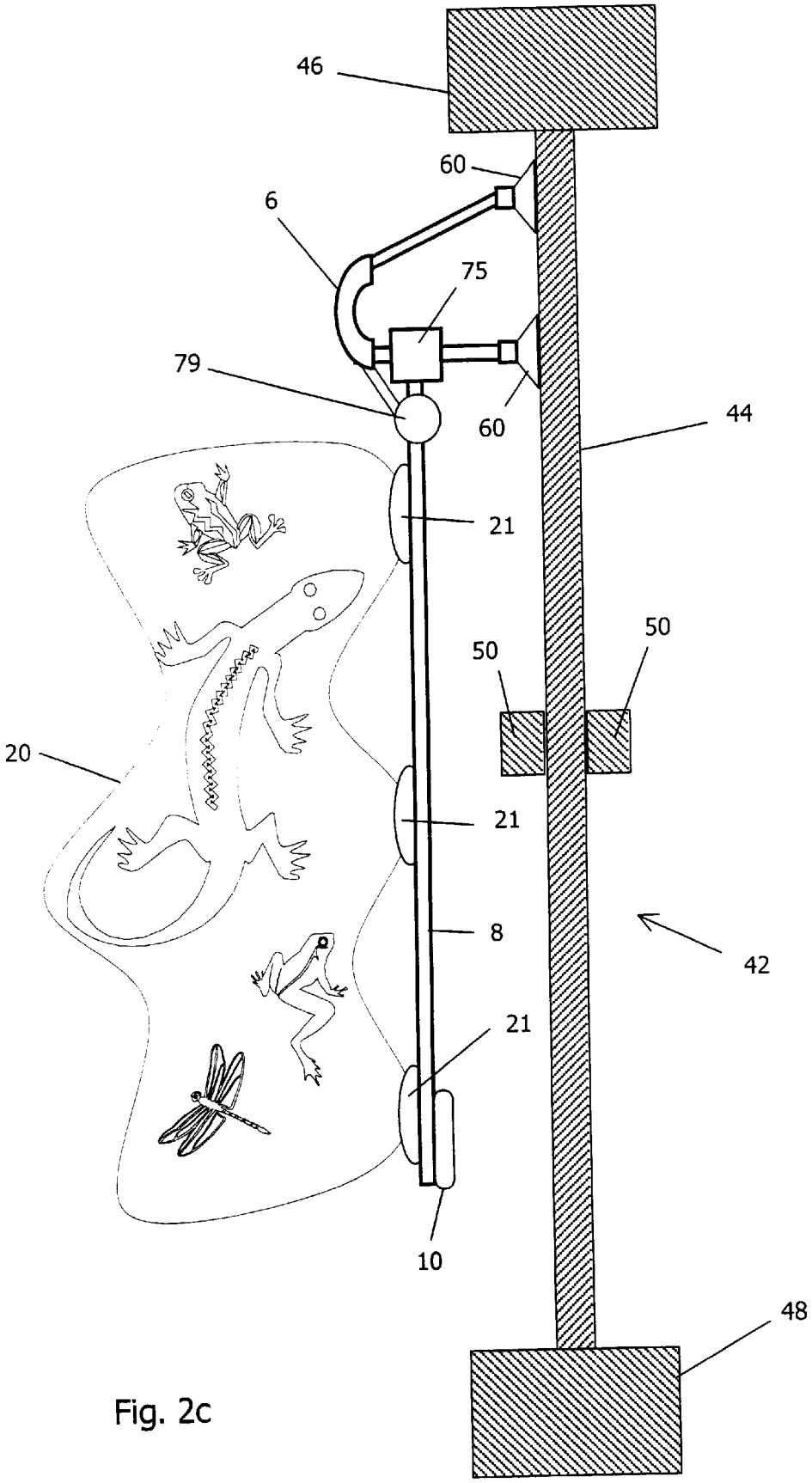
FIG. 2*c* is a side elevation view showing another alternative outdoor pendulum assembly.

Returning now to FIG. 1, the first pendulum rod 8 is preferably connected to the first support body 6 for pivoting the first magnetic pendulum 10 in a direction that is generally parallel to the window 42 (or other barrier). The sail 20 is preferably mounted to the first pendulum rod so as to extend generally perpendicular to the window 42 (or other barrier). Alternatively, the first magnetic pendulum 10 could be arranged to swing generally perpendicularly to the window 42 (or other barrier) and the sail 20 could mounted to extend generally parallel to the window 42. As best shown in FIG. 3, the first support body 6 is formed with a vertical slot 68 that accommodates the upper end of the first pendulum rod 8. A horizontal pivot pin hole 70 is formed in the first support body 6, transverse to the slot 68, to receive a pivot pin 72. The pivot pin 72 also extends through a second horizontal hole 74 (see FIG. 4) formed in the first pendulum rod 8, so as to pivotally connect the first pendulum rod 8 to the first support body 6. As shown in FIG. 2*c*, a bearing 75 could be used in lieu of the pivot pin 72.

Figure 4:
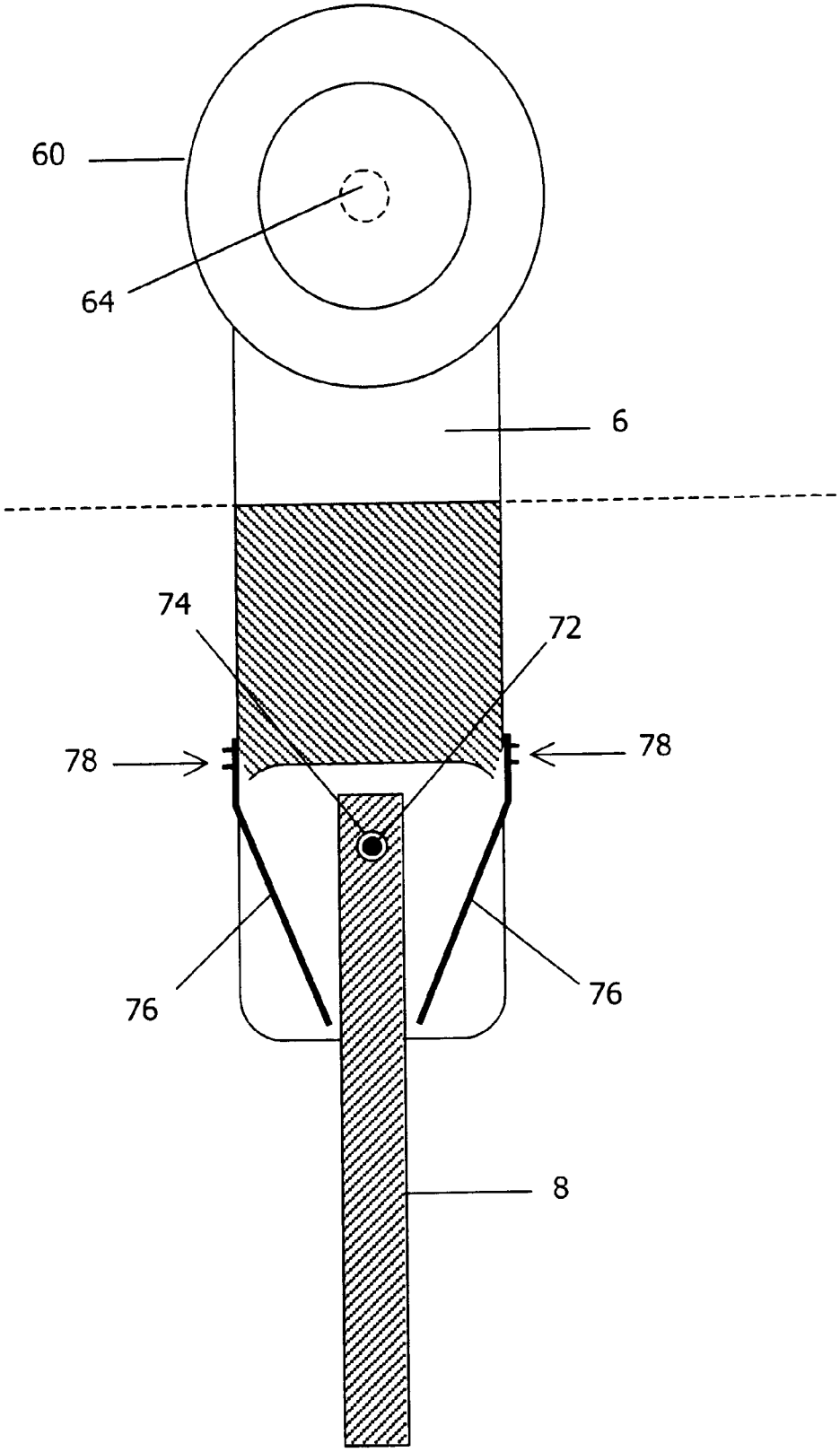
FIG. 4 is a cross-sectional view taken along line 4—4 in FIG. 3.

As can be best seen in FIG. 3 and 4, the outdoor pendulum assembly 4 may optionally include a pair of leaf springs 76 mounted on the first support body 6 for biasing the first pendulum rod 8 against pivotal movement. The springs 76 react to pivotal movement of the first magnetic pendulum 10 in either direction by engaging opposing sides of the first magnetic pendulum 10 and applying biasing forces that limits and dampens the oscillations of the first magnetic pendulum 10. The springs 76 also provide a certain amount of "bounce back" force so that the first magnetic pendulum 10 is not held to one side of its swing by the force of a continuous breeze. The springs 76 can be mounted on the first support body in any suitable fashion, such as by staples 78 or other kinds of fasteners. As an alternative to leaf springs, a pair of stops 79, one of which is shown in FIG. 2*c*, could be used to limit the swing of the first pendulum rod 8.

Figure 7:
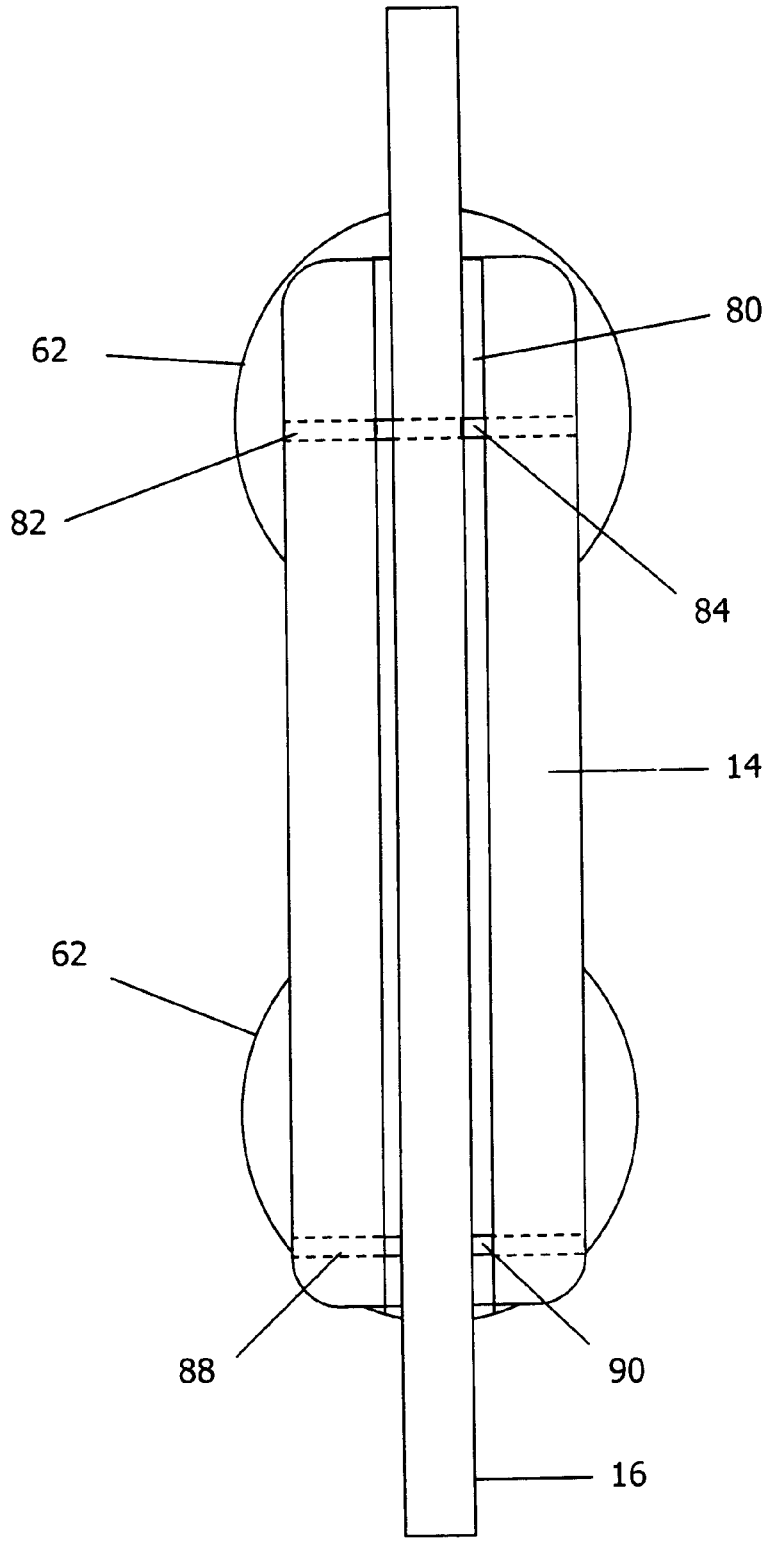
FIG. 7 is a detailed view of the upper portion of the indoor pendulum assembly of FIG. 5, taken in the direction of arrows 7—7 in FIG. 6.

Turning now to FIGS. 5–7, the indoor pendulum assembly 12 is preferably connected to the second support body 14 such that the second magnetic pendulum 18 pivots in a direction that is generally perpendicular to the window 42 (or other barrier). Alternatively, the second magnetic pendulum 18 could be arranged to pivot generally parallel to the window 42 (or other barrier). As best shown in FIG. 7, the second support body 14 is formed with a vertical channel 80 that accommodates the second pendulum rod 16. A horizontal pivot pin hole 82 is formed near the upper end of the second support body 14, and extends transversely to the vertical channel 80 to receive a pivot pin 84. The pivot pin 84 also mounts through a second horizontal hole 86 (see FIG. 6) formed in the second pendulum rod 16, so as to pivotally connect the second pendulum rod 16 to the second support body 14.

As further shown in FIGS. 5, 6 and 7, a third horizontal hole 88 is formed near the lower end of the second support body 14 to receive a limiting pin 90. The limiting pin 90 restricts the second pendulum rod 16 as it oscillates so that the second magnetic pendulum 18 does not swing into the window 42 (or other barrier).

Figure 5A:
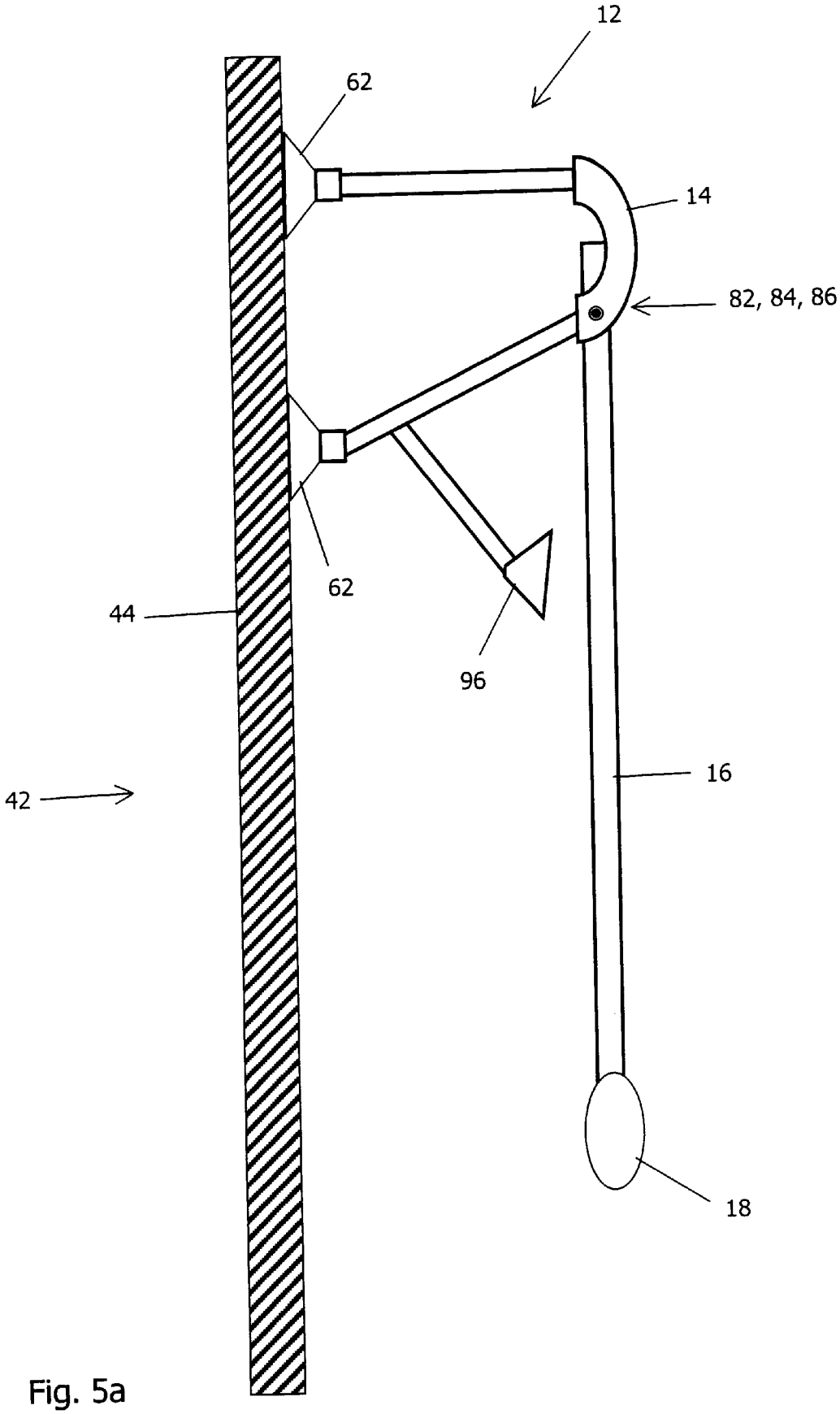
FIG. 5*a* is a side elevation view showing an alternative indoor pendulum assembly.
Figure 6A:
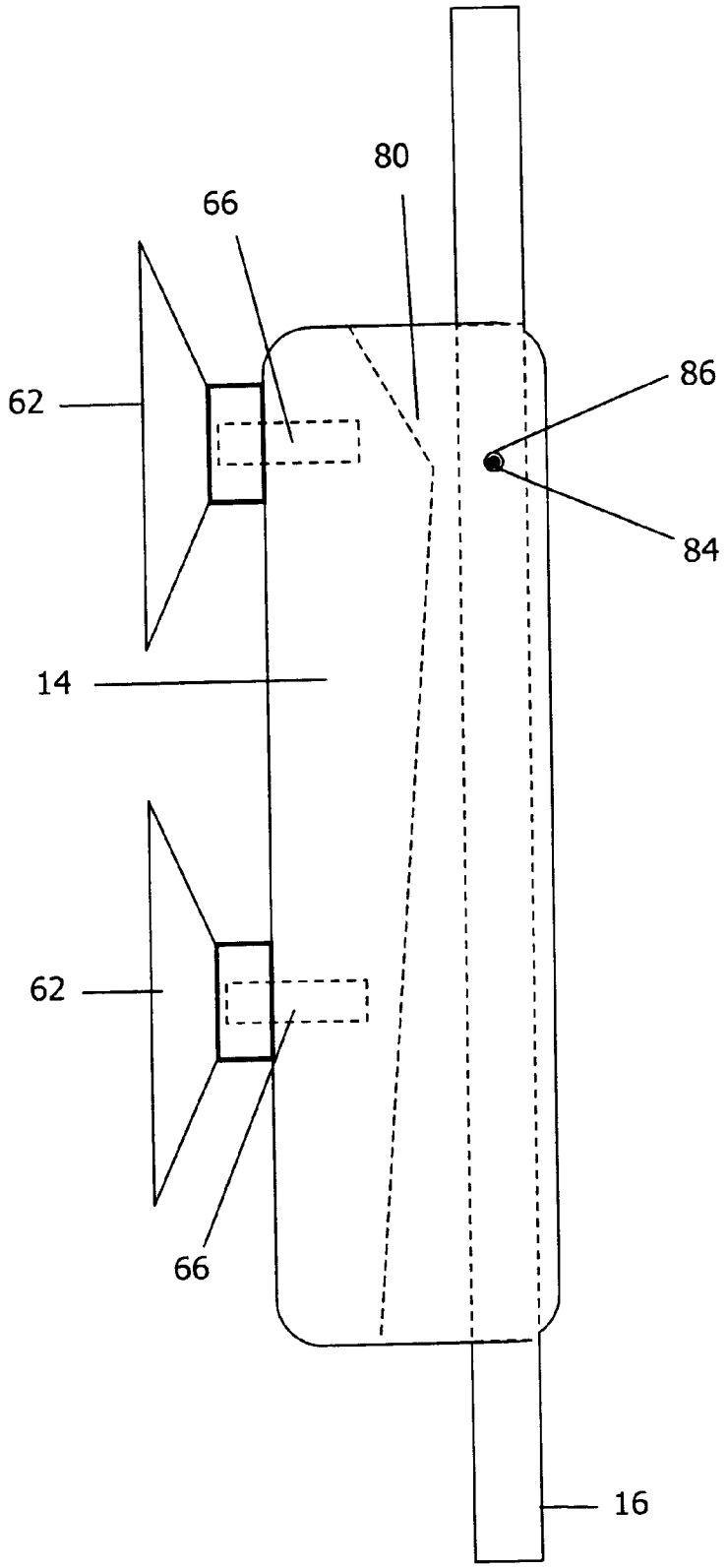
FIG. 6*a* is a detailed view showing an alternative construction for the upper portion of the indoor pendulum assembly of FIG. 5.
Figure 6B:
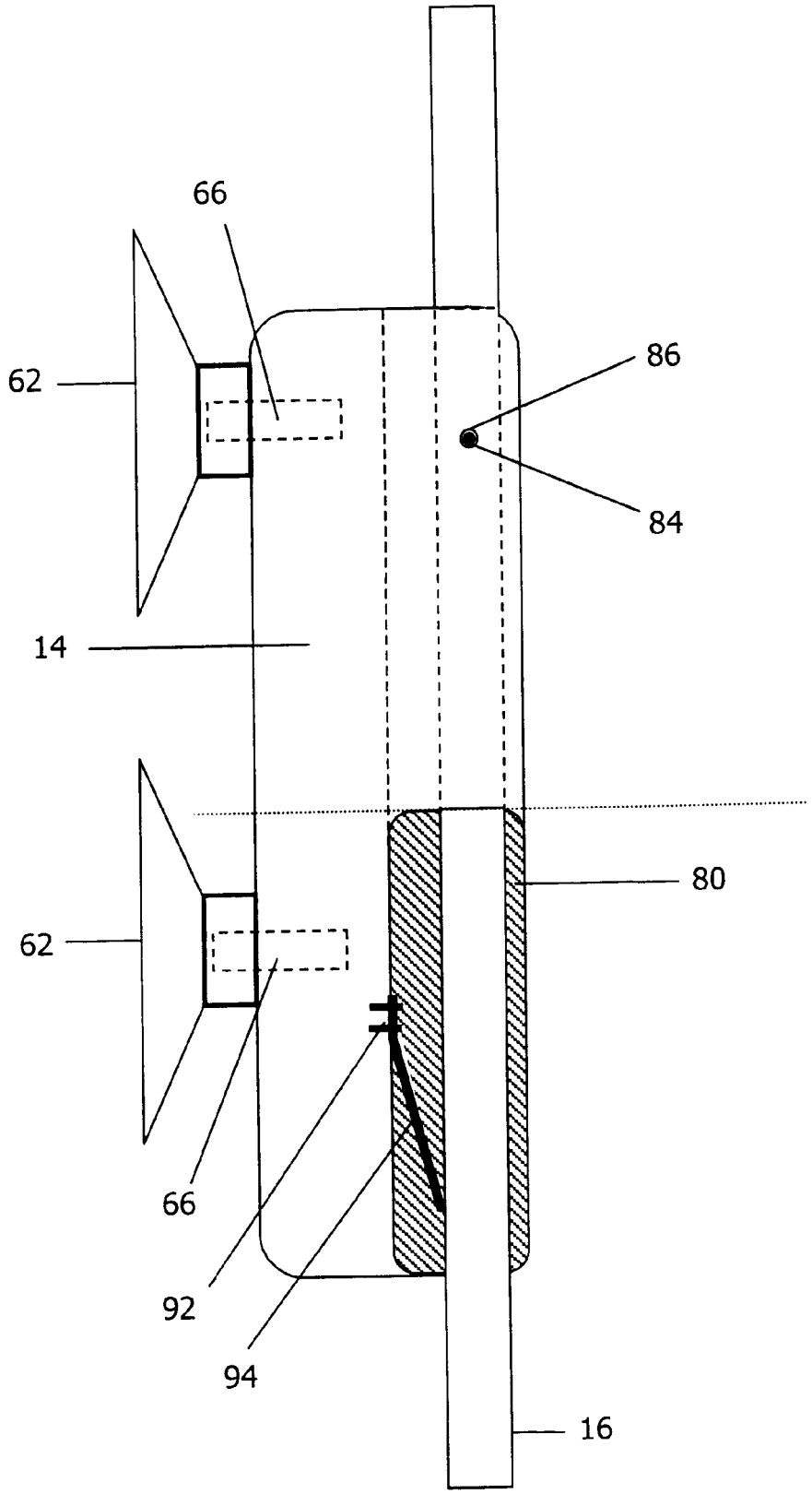
FIG. 6*b* is a detailed view showing another alternative construction for the upper portion of the indoor pendulum assembly of FIG. 5.

FIGS. 6*a* and 6*b* illustrates alternatives to the limiting pin arrangement shown in FIGS. 6 and 7. In FIG. 6*a*, the back surface of the channel 80 is angled as shown to limit the motion of the second pendulum rod as it swings toward the window 42 (or other barrier). In FIG. 6*b*, staples 92 are used to attach a leaf spring 94 to the back wall of the channel 80. The spring 94 resiliently limits the swing of the second pendulum rod 16 toward the window 42 (or other barrier). FIG. 5*a* shows a still further alternative wherein a pair of arms 96 extend from the second support body 14 to engage the second pendulum rod 16 as it swings toward the window 42 (or other barrier).

Figure 8:
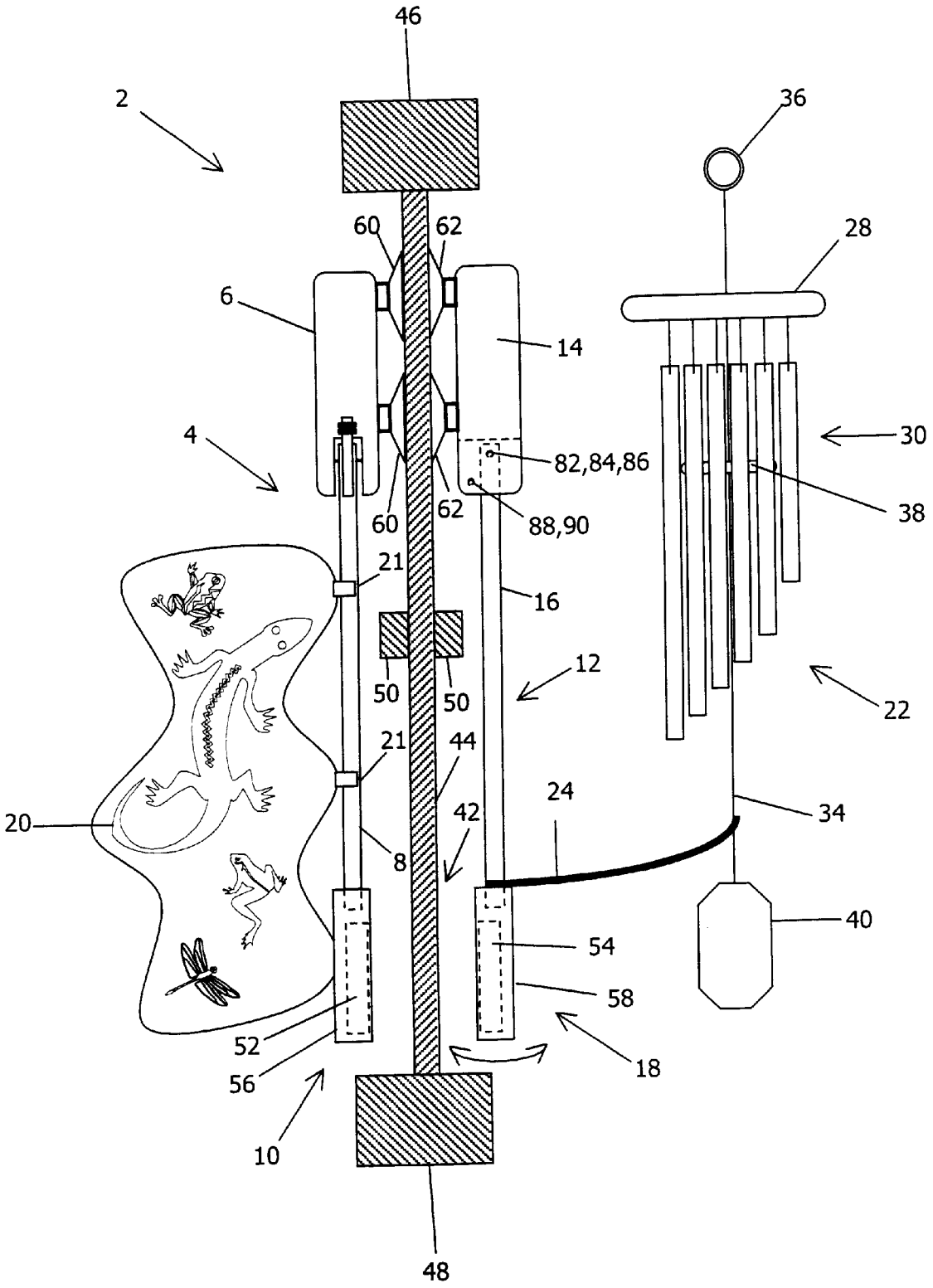
FIG. 8 is a side elevation view showing an alternative construction for a magnetically driven wind chime apparatus constructed in accordance with the invention, with the apparatus mounted on a window structure, which is shown cross-sectionally.

Turning now to FIG. 8, the magnetically driven wind chime apparatus 2 is shown in another aspect which is similar in most respects to the construction shown in FIGS. 1–7, except that the second pendulum rod is pivotally connected at a lower location on the second support body 16. In this aspect, the horizontal pin hole 82, the pivot pin 84 and the second horizontal hole 86 are located on the second support body 14 slightly above the location of the third horizontal hole 88 and the limiting pin 90. The second horizontal hole 86, moreover, is formed near the upper end of the second pendulum rod 16, to allow the second pendulum rod 16 to freely swing without hitting the back of the slot 80. FIG. 8 also illustrates the use of only a single lower leash 24. Although the lower leash 24 is sufficient to actuate the wind chime assembly 22, an upper leash is preferred because it imparts motion to the wind chime body 28, which also helps actuate the wind chime assembly 22.

With the wind chime apparatus 2 configured as shown in FIG. 1, the sail 20 of the outdoor pendulum assembly 4 catches breezes that flow past the window 42 (or other barrier). This causes the first magnetic pendulum 10 to oscillate under the action of gravity and the springs 76 or the arms 96 (if present). Because the first and second magnetic pendulums 10 and 12 are arranged with respective ones of their magnetic poles facing each other (e.g., N-N, S-S, N-S or S-N), the pendulums repel (or attract) each other. In this regard, the first and second pendulums 10 and 12 are separated by a distance that is calculated in relation to the magnetic strength thereof such that the first and second pendulums 10 and 12 moderately repel (or attract) each other through the window 42 (or other barrier).

As the first magnetic pendulum 10 oscillates back and forth in a direction parallel to the window 42 (or other barrier), its magnetic force causes the second magnetic pendulum 18 to oscillate back and forth in a direction perpendicular to the window 42 (or other barrier), in accordance with the change in proximity of the first magnetic pendulum 10. That is, every time the first magnetic pendulum 10 swings near the second magnetic pendulum 18, they are forced apart (or together) by magnetic repulsion (or attraction) and the second magnetic pendulum 18 swings away from (or toward) the window 42 (or other barrier). As the first magnetic pendulum 10 swings away from the second magnetic pendulum 18, the strength of the magnetic repulsion (or attraction) lessens, allowing the second magnetic pendulum 18 to swing back towards (or away from) the window 42 (or other barrier). This causes the oscillation or "rocking" motion in the second magnetic pendulum 18.

The rocking motion of the second magnetic pendulum 18 is transferred to the wind chime assembly 22 through the upper and lower leashes 24. The upper leash 24 shakes the wind chime support body 28 (either directly or through the suspension string 34) and the lower leash 24 shakes the striker 38 attached to the suspension string 34. The result is that the wind chime assembly 22 generates the same random sounds that would be generated if it was located outdoors. Advantageously, there is no need to penetrate or circumvent the window 42 (or other barrier), and the apparatus 2 can be removed and located elsewhere with little effort.

The motion imparted to the wind chime assembly 22 can be varied by adjusting the position of the sail 20 as well as the weight of the magnetic pendulums 10 and 18, their magnetic strength, and their mounting location on the respective first and second pendulum rods 8 and 16. Mounting the sail 20 near the bottom of the first pendulum rod 8 requires less wind force to drive the wind chime assembly 2 than if the sail 20 is mounted near the top of the first pendulum rod 8. The weight and mounting location of the magnetic pendulums 10 and 18 affects the oscillation period and the amplitude of pendulum swing in the presence of zero to moderate winds. The weight and mounting location also affect wind responsiveness, but not so much as the placement of the sail 20. Heavy pendulums or pendulums mounted close to the respective pivot pins 72 and 84 require more wind force than lighter pendulums or pendulums mounted far from the pivot pins. If, the magnetic pendulums 10 and 18 are too light or too far from the pivot pins, or if the wind is too strong, the pendulums may not oscillate or take too long to return from one side of their swing.

With the wind chime apparatus 2 configured as shown in FIGS. 1–8, it is preferred that the magnetic pendulums 10 and 18 be mounted so as to exert mutual repulsive forces on each other. In this way, the second magnetic pendulum 18 will be urged away from the window 42 (or other barrier) rather than toward it. This allows the first and second magnetic pendulums 10 and 18 to be placed relatively close to the window 42 (or other barrier) without the risk of impact. If the first and second magnetic pendulums 10 and 18 are arranged to exert a mutual attractive force on each other, it is preferable to configure both pendulum assemblies 4 and 12 so that the first and second magnetic pendulums 10 and 18 move generally parallel to the window 42 (or other barrier). To reduce friction, appropriate bearings can be installed to mount the first and second pendulum rods 8 and 16 to the respective first and second support bodies 6 and 14.

While the foregoing description has focused on a wind chime specifically, it will be appreciated that the concepts underlying the invention could be applied more broadly to provide a magnetically coupled, trans-barrier, motion transmitting apparatus that actuates either a wind chime, a mobile, or any other suitable device through a window or other barrier. Such an apparatus may be constructed in one aspect using the pendulum assemblies 4 and 12 of FIGS. 1–8. Again, with reference to FIG. 1, the first and second magnetic pendulums 10 and 18 would be disposed in opposing relationship with their magnetic fields aligned so that each exerts a mutual magnetic repulsive (or attractive) force on the other, such that the first magnetic pendulum 10 imparts translational motion to the second magnetic pendulum 18 as the first magnetic pendulum 10 itself engages in translational motion. Although FIG. 1 shows a sheet sail 20 mounted on the first pendulum rod 8, the sail 20 could be any other suitable sensing or impelled device, as previously stated. Similarly, the wind chime assembly 22 could be substituted with any suitable energy receiving device.

Depending on the application, the pendulum assemblies 4 and 12 of FIGS. 1–8 could be modified by mounting more than one magnetic pendulum per pendulum rod. Two magnetic pendulums on each pendulum rod could be arranged so that the lower two pendulums repel and the higher two pendulums attract. The pendulums would react to each other as if attached or bound by two sets of forces, to provide synchronized coupling. Another alternative would be to mount a bar or horseshoe magnet on each pendulum with their magnetic poles oriented parallel to the window 42 (or other barrier). In this way, the magnetic poles of one magnet would engage its counterpart magnetic pole on the other magnet.

In a further variation, the pendulum assemblies 4 and 12 of FIGS. 1–8 could be modified so that the first and second pendulums 10 and 18 swing perpendicular to the window 42 (or other barrier) and so that each exerts a mutual repulsive force on the other, but with the first magnetic pendulum 10 being lighter than the second magnetic pendulum 18. In this configuration, the system remains static unless a significant amount of force is applied to the lighter magnetic pendulum 10. This provides a magnetic "pushbutton" that operates without electricity. This pushbutton could reach into a closed container without the extra design or construction effort entailed in penetrating or circumventing the closure with a conventional switch or linking apparatus.

Figure 9:
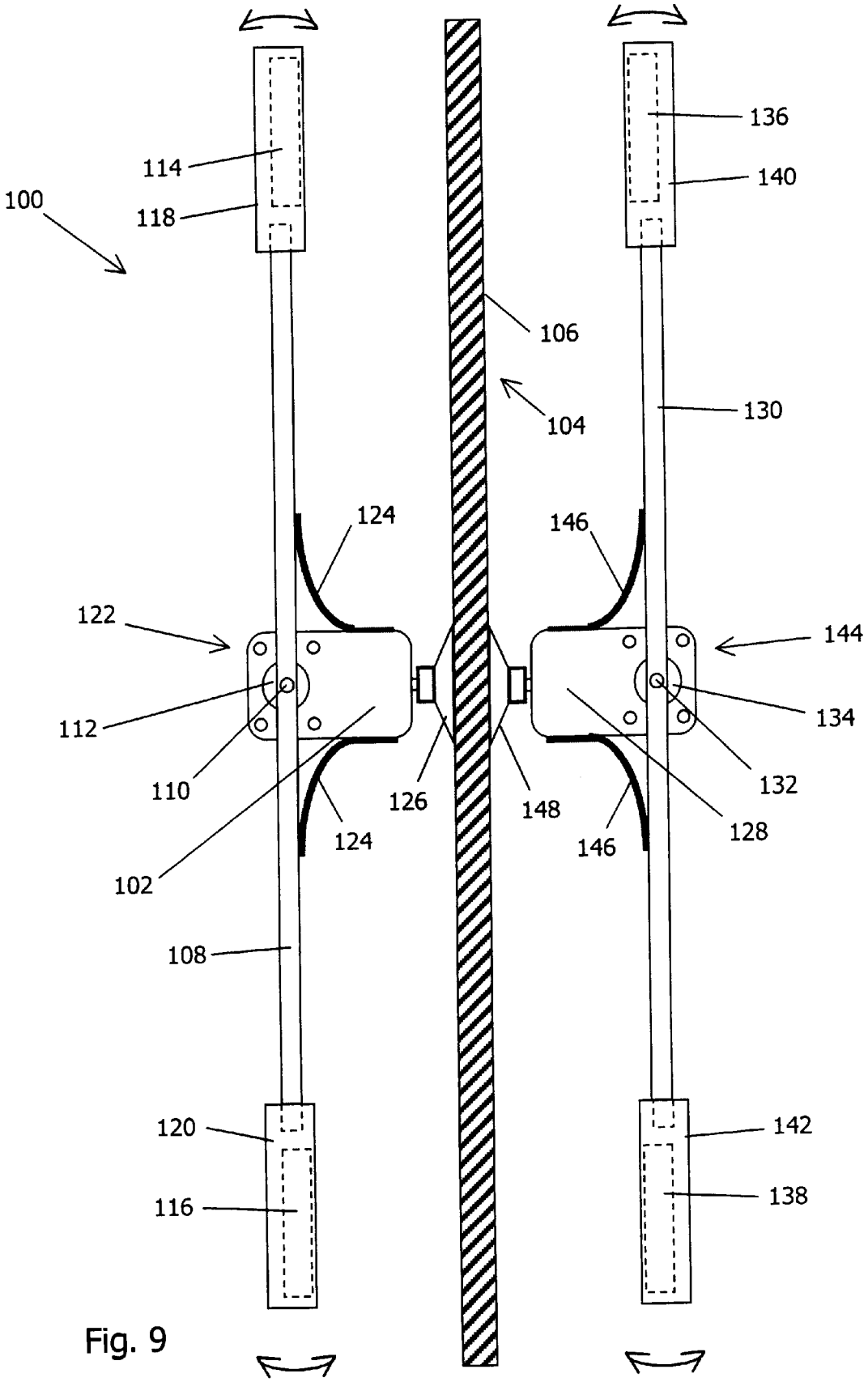
FIG. 9 is a side elevation view of a magnetically coupled, trans-barrier, motion transmitting apparatus constructed in accordance with another embodiment of the invention, with the apparatus mounted on a window structure, which is shown cross-sectionally.

Turning now to FIG. 9, a magnetically coupled, trans-barrier, motion transmitting apparatus 100 is shown in a second aspect. Here, a first support body 102 is mounted on a window 104 (or other barrier) that includes a window pane 106. A first pivot rod 108 is pivotally connected at a central portion thereof to the first support body 102. More specifically, the first pivot rod 108 is pinned at 110 to a bearing 112 that is mounted in a recess in the first support body 102. A pair of magnets 114 and 116 are mounted in housings 118 and 120, respectively, which are secured at opposing ends of the first pivot rod 108. Four limiting pins 122 are provided to limit the pivotal movement of the first pivot rod 108. Two leaf springs 124 are secured to the first support body 102 to dampen and control the oscillations of the first pivot rod 108. A suction cup 126 secures the first support body 102 to the window pane 106. A suitable adhesive could also be used in lieu of the suction cup 126.

A second support body 128 is mounted on the window 104 (or other barrier). A second pivot rod 130 is pivotally connected at a central portion thereof to the second support body 128. More specifically, the second pivot rod 130 is pinned at 132 to a bearing 134 that is mounted in a recess in the first support body 128. A pair of magnets 136 and 138 are mounted in housings 140 and 142, respectively, which are secured at opposing ends of the second pivot rod 130. Four limiting pins 144 are provided to limit the pivotal movement of the second pivot rod 130. Two leaf springs 146 are secured to the second support body 128 to dampen and control the oscillations of the second pivot rod 130. A suction cup 148 secures the second support body 128 to the window pane 106. A suitable adhesive could also be used in lieu of the suction cup 148.

In operation, the first pivot rod 108 is actuated in suitable fashion to oscillate the magnets 114 and 116 in a direction that is generally perpendicular to the window 104. The magnets 114 and 116 are located in spaced opposing relationship with the magnets 136 and 138, respectively, with the poles of each opposing magnet pair being aligned (i.e., N-N, S-S, N-S or S-N) to produce a mutual repulsive (or attractive) force. As the magnets 114 and 116 oscillate, they magnetically induce corresponding oscillations in the magnets 136 and 138; namely, the magnets 136 and 138 oscillate in a direction that is generally perpendicular to the window 104. More specifically, as the magnet 114 swings toward or away from the window 104, it pushes or pulls the magnet 136 toward or away from the window 104. At the same time, the magnet 138 swings toward or away from the window 104, and it pushes or pulls the magnet 116 toward or away from the window 104. The effect if that of a parallel four bar linkage, with two of the linkages being the first and second pivot rods 108 and 130, and the remaining two linkages being the magnetic couplings between the magnets 114/136 and 116/142.

Accordingly, a magnetically driven wind chime apparatus and a related trans-barrier motion transmitting apparatus have been described. While various embodiments have been disclosed, many other variations would also be possible within the scope of the invention. It is understood, therefore, that the invention is not to be in any way limited except in accordance with the spirit of the appended claims and their equivalents.

What is claimed is:

1. A magnetically driven wind chime apparatus, comprising:

a first assembly mounted on a first side of a window or other barrier, said first assembly including a first movable magnet and a sail;

a second assembly mounted on a second side of a window or other barrier, said second assembly including a second movable magnet and a wind chime; and said first and second magnets being disposed in opposing relationship with their magnetic fields aligned so that each exerts a mutual magnetic repulsive or attractive force on the other, whereby said first assembly imparts motion to said second assembly as said sail is moved by a wind, and said wind chime generates its characteristic chiming sounds as said second assembly is moved by said first assembly.

2. A magnetically driven wind chime apparatus, comprising:

a first pendulum assembly including a first support body, a first pendulum rod having one end pivotally connected to said first support body, and a first magnetic pendulum mounted to a second end of said first pendulum rod;

a second pendulum assembly including a second support body, a second pendulum rod having one end pivotally connected to said second support body, and a second magnetic pendulum mounted to a second end of said second pendulum rod;

a sail mounted on said first pendulum rod;

a wind chime assembly connected to said second pendulum rod; and said first and second pendulum assemblies being respectively mounted to the outside and inside surfaces of a window or other barrier with said first and second magnetic pendulums in opposing relationship with their magnetic fields aligned so that each exerts a mutual magnetic repulsive or attractive force on the other, whereby said first pendulum assembly imparts motion to said second pendulum assembly as said sail is moved by a wind, and said second pendulum assembly imparts motion to said wind chime assembly as said second pendulum assembly is moved by said first pendulum assembly.

3. A magnetically driven wind chime apparatus in accordance with claim 2 wherein said first and second pendulum assemblies are mounted to said window or other barrier by mounting members attached to said first and second support bodies.

4. A magnetically driven wind chime apparatus in accordance with claim 3 wherein said mounting members are suction cups.

5. A magnetically driven wind chime apparatus in accordance with claim 2 wherein said first pendulum rod is connected to said first support body for pivoting said first magnetic pendulum generally parallel to said window or other barrier and wherein said second pendulum rod is connected to said second support body for pivoting said second magnetic pendulum generally perpendicular to said window or other barrier.

6. A magnetically driven wind chime apparatus in accordance with claim 2 wherein said sail is has a sheet configuration and is mounted to said first pendulum rod so as to extend generally perpendicular to said window or other barrier.

7. A magnetically driven wind chime apparatus in accordance with claim 2 wherein said wind chime assembly is connected to said second pendulum rod using a leash.

8. A magnetically driven wind chime apparatus in accordance with claim 2 wherein said wind chime assembly is connected to said second pendulum rod using a pair of leashes mounted to upper and lower portions of said second pendulum rod, respectively.

9. A magnetically driven wind chime apparatus in accordance with claim 5 wherein said first pendulum assembly includes springs on said first support body for biasing said first pendulum rod against pivotal movement so as to return said first magnetic pendulum to a neutral position and wherein said second pendulum assembly includes a limiting member for restricting said second pendulum rod as it moves so that said second magnetic pendulum does not swing against said window or other barrier.

10. A magnetically driven wind chime apparatus in accordance with claim 9 wherein said springs are a pair of leaf springs mounted on first support body to engage opposing sides of said first pendulum rod.

11. A magnetically driven wind chime apparatus in accordance with claim 9 wherein said second pendulum rod is connected to an upper location on said second support body, and wherein said limiting member is mounted to a lower location on said second support body.

12. A magnetically driven wind chime apparatus in accordance with claim 2 wherein said second pendulum rod is connected to a lower location on said second support body, and wherein said limiting member is also mounted to a lower location on said second support body, below the location where said second pendulum rod connects to said second support body.

13. A magnetically driven wind chime apparatus in accordance with claim 2 wherein said first and second magnetic pendulums each include a nonmagnetic pendulum housing having a recess that supports a magnet therein.

14. A magnetically driven wind chime apparatus in accordance with claim 7 wherein said wind chime assembly includes a suspended wind chime paddle connected through a suspension string to a wind chime striker that is positioned to contact a plurality of chimes when said paddle is moved, and wherein said leash is connected to said suspension string.

15. A magnetically driven wind chime apparatus in accordance with claim 8 wherein said wind chime assembly includes a suspended wind chime paddle connected through a suspension string to a wind chime striker that is positioned to contact a plurality of chimes suspended from a wind chime body in response to said wind chime paddle being moved, and wherein said lower leash is connected to said suspension string or to said wind chime paddle and said upper leash is connected to said wind chime body or to said suspension string.

16. A magnetically coupled, trans-barrier, motion transmitting apparatus for actuating a wind chime or other device through a window or other barrier, comprising:

a first assembly mounted on a first side of the window or other barrier, said first assembly including a first magnet adapted for translational movement relative to said window or other barrier;

a second assembly mounted on a second side of a window or other barrier, said second assembly including a second magnet adapted for translational movement relative to said window or other barrier; and said first and second magnets being disposed in opposing relationship with their magnetic fields aligned so that each exerts a mutual magnetic repulsive or attractive force on the other, whereby said first magnet imparts translational motion to said second magnet as said first magnet engages in translational motion.

17. A magnetically coupled, trans-barrier, motion transmitting apparatus in accordance with claim 16 wherein said first assembly includes a first support body mounted on said window or other barrier, a first pendulum rod pivotally connected at a first end thereof to said first support body, and said first magnet is a magnetic pendulum mounted to a second end of said first pendulum body, and wherein said second assembly includes a second support body mounted on said window or other barrier, a second pendulum rod pivotally connected at a first end thereof to said second support body, and said second magnet is a magnetic pendulum mounted to a second end of said second pendulum body.

18. A magnetically coupled, trans-barrier, motion transmitting apparatus in accordance with claim 17 wherein said first pendulum rod is connected to said first support body such that said first magnet moves generally parallel to said window or other barrier, and wherein said second pendulum rod is connected to said second support body such that said second magnet moves generally perpendicular to said window or other barrier.

19. A magnetically coupled, trans-barrier, motion transmitting apparatus in accordance with claim 16 wherein said first assembly includes a first support body mounted on said window or other barrier, a first pivot rod pivotally connected at a central portion thereof to said first support body, and said first magnet is a pair of magnets mounted to opposing ends of said first pivot rod, and wherein said second assembly includes a second support body mounted on said window or other barrier, a second pivot rod pivotally connected at a central portion thereof to said second support body, and said second magnet is a pair of magnets mounted to opposing ends of said second pivot rod.

20. A magnetically coupled, trans-barrier, motion transmitting apparatus in accordance with claim 19 wherein said first and second pivot rods are connected to said first and second support bodies such that said first and second magnets move generally perpendicular to said window or other barrier, and wherein said first and second assemblies further includes springs and limiting pins mounted on said first and second support bodies and engaging said first and second pivot rods to dampen and control the movement of said first and second magnets and prevent said first and second magnets from swinging into said window or other barrier.

* * * * *